United States Patent [19]

Nelson et al.

[11] Patent Number: 4,798,554

[45] Date of Patent: Jan. 17, 1989

[54] BALLOON HOLDER

[76] Inventors: David C. Nelson, 1585 S. Cleveland-Massillon Rd.; Michael J. Fresh, 3448 Copley Rd., both of Copley, Ohio 44321; Herbert Müeller, Herznach, Switzerland

[21] Appl. No.: 185,291

[22] Filed: Apr. 19, 1988

Related U.S. Application Data

[63] Continuation of Ser. No. 023,546, Mar. 19, 1987, abandoned, which is a continuation-in-part of Ser. No. 838,516, Mar. 11, 1986, Pat. No. 4,715,841.

[51] Int. Cl.[4] ..... A63H 3/06

[52] U.S. Cl. ..... 446/222; 446/220

[58] Field of Search ..... 206/315.1; 446/220, 446/223, 222; 24/30.5 S, 30.5 R, 545, 555

[56] References Cited

U.S. PATENT DOCUMENTS

| | | | |
|---|---|---|---|
| 1,994,202 | 3/1935 | Sarsfield | 446/222 |
| 2,664,667 | 1/1954 | Burroughs | 446/222 |
| 2,840,948 | 7/1958 | Stickley | 446/223 |
| 3,267,604 | 8/1966 | Goldsmith | 446/222 |
| 4,428,149 | 1/1984 | Brown | 446/222 |
| 4,589,854 | 5/1986 | Smith | 446/223 |
| 4,661,081 | 4/1987 | Basseches | 446/222 |

FOREIGN PATENT DOCUMENTS

| | | | |
|---|---|---|---|
| 0105179 | 4/1984 | European Pat. Off. | 446/222 |
| 1384510 | 11/1964 | France | 446/222 |
| 2093709 | 9/1982 | United Kingdom | 446/222 |

*Primary Examiner*—David T. Fidei

*Attorney, Agent, or Firm*—Renner, Kenner, Greive, Bobak Taylor & Weber

[57] ABSTRACT

Disclosed are one-piece, funnel shaped balloon holders, comprising a conical cup and a hollow cylindrical stem. A longitudinal slit extends the entire length of the balloon holder, from the upper edge of the cup to the lower end of the stem, to permit insertion of the neck of a balloon into the holder. A short slot at the bottom of the stem anchors the balloon tail. In a first embodiment (FIGS. 1–3), a balloon stick is inserted into the hollow stem. In a second embodiment (FIGS. 4–8) the stem is inserted into one end of a hollow balloon stick. The stem in this embodiment is of such shape as to provide space between the stem and the balloon stick for a portion of the balloon neck so that the entire balloon neck is concealed.

7 Claims, 3 Drawing Sheets

BALLOON HOLDER

CROSS REFERENCE TO RELATED APPLICATION

This application is a continuation of Ser. No. 023,546, filed Mar. 9, 1957, now abandoned, which is a continuation-in-part of applicants' copending U.S. application, Ser. No. 838,516, filed Mar. 11, 1986, now U.S. Pat. No. 4,715,841, issued Dec. 29, 1987. This application is also based in part on commonly assigned European patent application No. 6810013.2, filed Jan. 15, 1986. Said European patent application is based on Swiss application No. 04413/85-8 (now abandoned) and Herbert Mueller (one of the inventors herein) is the named inventor in both applications.

TECHNICAL FIELD

This invention relates to balloon holders and more particularly to balloon holders of the type comprising a cup for receiving a balloon and a stem for holding a balloon stick.

BACKGROUND ART

Large numbers of inflatable toy balloons are sold or given away as novelty items each year. Toy balloons are of two general types, those made of an elastomeric material, either rubber or latex, and those made of a non-elastomeric polymer film, usually polyethylene terphthalate ("Mylar"). Latex balloons are stretchable, typically have a short neck surrounding the inflation opening, and may be sold either collapsed or inflated. When sold in inflated form, they may be tied to a stick; usually they are tied directly to a stick without the aid of a holder. "Mylar" balloons are non-stretchable, typically are metallized to give a silvery appearance, have a long neck typically about four inches (10 cm) long, and are usually distributed in inflated form secured to a stick by means of a balloon holder.

Balloon holders currently in use are of various designs, but invariably such a balloon holder comprises a funnel-shaped body having a cup for receiving the balloon itself, and a stem for holding the balloon stick. The cup typically has one or more cutouts (e.g. holes or slots) for engaging the neck to secure the balloon to the cup; the neck is wound around the outside of the cup and is secured near its ends to one or two of these holes or slots. The stem is generally a hollow cylinder or tube, closed at its upper end and open at its lower end. One end of the balloon stick is inserted into the open end of the tube.

Known balloon holders have several disadvantages. First, this type of balloon holder does not center the balloon. Because the holes or slots are off center, the balloon is also off center when secured to the holder, and the balloon is not always at the same angle. Also, as a consequence of being off center, the balloon is not firmly secured to the holder, which could allow the balloon to slip out of the holes or slots and escape. Another disadvantage of present balloon holders is poor esthetics. The balloon neck is visible on the outside of the cup, and the free end of the neck usually sticks out, i.e. away from the cup. Also, considerable finger dexterity is required to secure a balloon to a balloon holder of this type. Finger dexterity is greatly reduced in cold weather, and it is extremely difficult or almost impossible to wind a balloon neck around the cup while wearing gloves. Winding of the balloon neck is particularly difficult if the balloon is of the metallized non-elastomeric film type.

DISCLOSURE OF THE INVENTION

An object of this invention is to center a balloon over the balloon holder.

Another object of this invention is to fasten the balloon securely to the holder.

Still another object of this invention is to conceal the neck of the balloon when it is secured to the holder.

Still another object of this invention is to provide a balloon holder to which a balloon can be readily secured, even in cold weather.

These and other objects of the invention will be apparent from the description which follows.

According to the present invention, there is provided a one piece balloon holder or balloon holding device comprising a cup and a stem extending longitudinally therefrom, in which the cup has a longitudinal slit for insertion of the neck of a balloon and in which the stem is adapted to hold one end of a balloon stick and has means near its outer end for engaging the balloon neck. In preferred embodiments of the invention the balloon holder is funnel-shaped, the stem is hollow and generally cylindrical, and the longitudinal slit extends the entire length of the device, i.e. the entire lengths of both the cup and the stem.

Two embodiments of this invention are disclosed. The first is designed for insertion of a balloon stick (either solid or hollow) inside the hollow stem of the balloon holder. The second is designed for insertion of the stem into one end of a hollow balloon stick, the stem being of such shape as to provide space to conceal the balloon neck inside the balloon stick.

BEST MODE FOR CARRYING OUT INVENTION

This invention is useful for securing either long-necked "Mylar" balloons or short-necked latex balloons to balloon sticks. This invention will be described in detail with reference to preferred embodiments which are particularly useful for securing long-necked balloons to balloon sticks.

Balloon holders according to this invention are of one-piece construction and are preferably made of a rigid to semi-rigid plastic material, such as polypropylene, high-impact polystyrene, acrylonitrile-butadiene-styrene (ABS) or rigid polyvinyl chloride (PVC) by injection molding.

Figure 1:
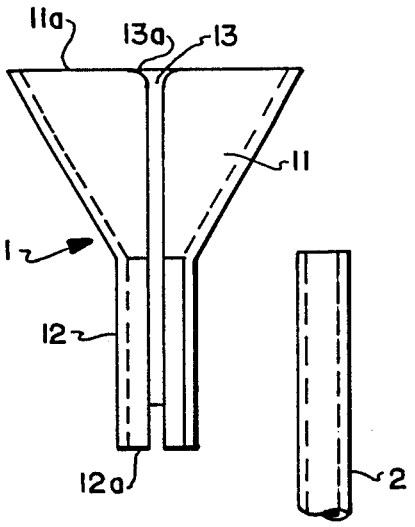
FIG. 1 is a side view of a balloon holder according to a first embodiment of the invention, and a partial view of a balloon stick for insertion into the stem of said balloon holder.
Figure 2:
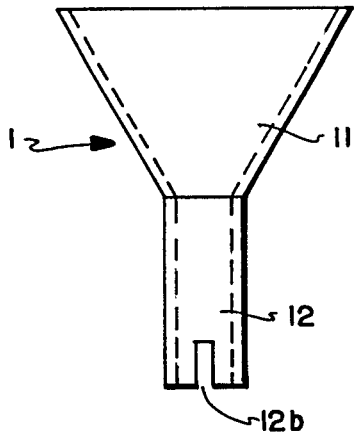
FIG. 2 is a side view of the balloon holder of FIG. 1, as seen from the opposite side of the balloon holder.
Figure 3:
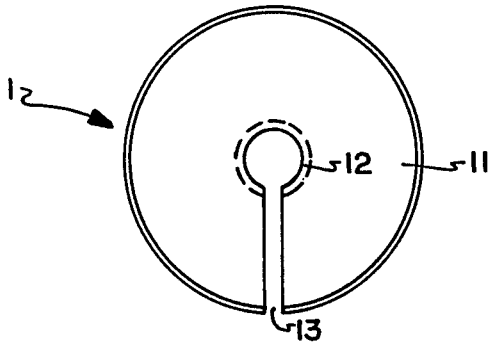
FIG. 3 is a top view of the balloon holder of FIG. 1.
Figure 4:
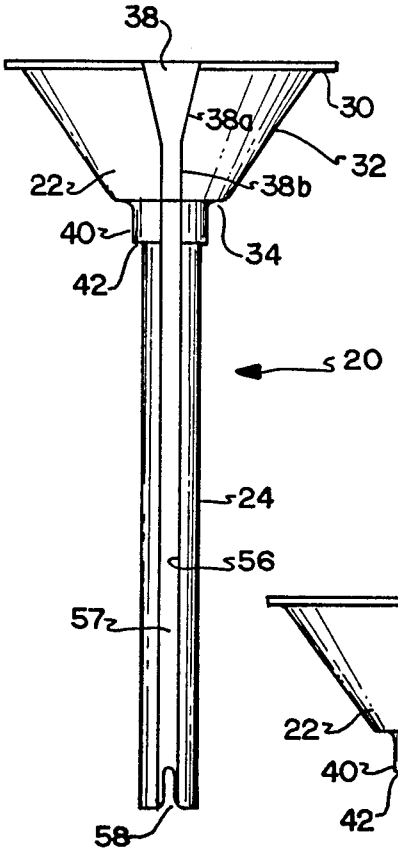
FIG. 4 is a front elevational view of a balloon holder device, according to a second embodiment of this invention.
Figure 7:
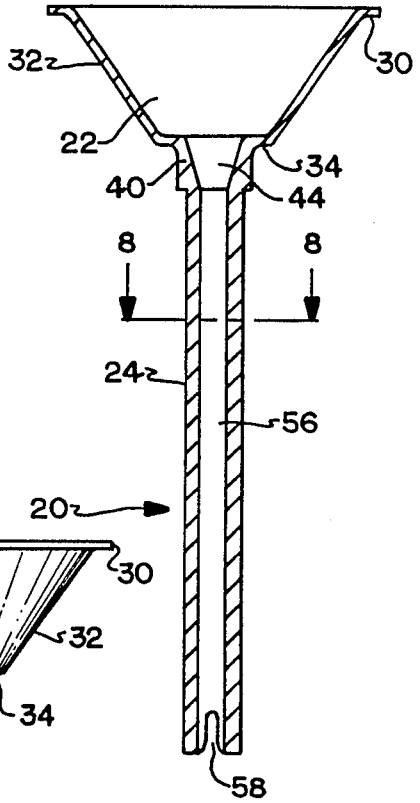
FIG. 7 is a vertical sectional view taken along line 7—7 of FIG. 6.

This invention will now be described in detail with reference to a first embodiment thereof, as shown in FIGS. 1 to 3 of the drawings.

Referring now to FIG. 1, balloon holder (or balloon holding device) 1 is a funnel-like one-piece body which is designed to receive a cylindrical balloon stick 2 of circular cross-section. Balloon stick 2 can be either solid or hollow. Balloon holder 1 and balloon stick 2 together constitute a clamping device which is capable of clamping the neck of a balloon.

Balloon holder 1 is made of a plastic material which is not excessively hard and which, even though not soft, is nevertheless elastic. Polypropylene is the preferred material for this embodiment. The funnel-like body comprises a conical cup 11 and a hollow cylindrical stem 12 joined thereto. The cup 11 is the upper portion and the stem 12 is the lower portion when balloon holder 1 is upright (which is the correct orientation for holding a balloon). Whereas the stem 12 is preferably of circular cross-section, the cup 11 may be of either circular or oval cross-section; devices with circular cross-section being better suited for spherical rubber balloons, devices with either circular or oval cross-section being suited for metallized plastic balloons. Balloon holder 1 is open at both ends. Thus, cup 11 is open at its outer edge (or top) 11*a*, and stem 12 is open at its lower or outer end 12*a*. The entire balloon holder is provided with a longitudinal slit 13 extending from the outer end 12*a* of the stem 12 to the outer edge 11*a* of the cup running (in the embodiment shown) vertically along a generatrix. However, the slit 13 can have a different shape. Of importance is, however, that it be made to extend along the entire length of the funnel-like balloon holder to enable it to fulfill its purpose described below. The slit 13 preferably has an enlargement 13*a* at its end that opens into the funnel edge 11*a*. The stem 12 of the balloon holder 1 has a slot 12*b* that starts at the outer edge 12*a* of stem 12 and extends over only a small portion of the stem length. Slot 12*b* is located diametrically opposite slit 13. The inside diameter and the wall thickness of the stem 12 and the outside diameter of the balloon stick 2, which preferably consists of a plastic tube, are so dimensioned, that the stick 2 may be inserted into the stem 12 and fixedly clamped therein by virtue of the elastic properties of the cylindrical part that surrounds it. In short, the outside diameter of the balloon stick 2 is just slightly less than the inside diameter of stem 12.

The air-filled balloon is clamped by sliding the balloon holder 1 onto the balloon neck, which, subsequent to filling the balloon with air, is usually twisted to a certain extent. This process of sliding-on is accomplished not by inserting the neck longitudinally through the funnel-like balloon holder 1, but rather by inserting the neck into the balloon holder 1 by way of the slit 13, i.e. from the side. The process of sliding the balloon holder 1 onto the neck from the side requires no manual dexterity of any kind and may be accomplished by means of a gloved hand with no difficulty. The balloon holder 1 is then displaced on the balloon neck in the direction away from the outer end 12*a* of stem 12 until the outer edge of rim 11*a* of cup 11 abuts against the air-filled balloon envelope, so that the latter receives proper support. Subsequently, the free end of the balloon neck is pulled into the slot 12*b* from the side, so that the end 12*a* of stem 12 becomes free and the balloon stick may be inserted in place. This insertion as the effect of clamping the filler stud of the balloon between the balloon stick 2 and the inner wall of the stem 12, and to hold it there with adequate safety, to prevent any air from escaping from the balloon.

The embodiment of FIGS. 1–3 is particularly suitable for use with latex and 4 inch or smaller diameter metallized "Mylar" balloons.

FIGS. 4 to 8 illustrate a balloon holder according to a second embodiment of this invention. The preferred material for this embodiment is high impact polystyrene. Referring to FIGS. 4–8, 20 is a one-piece funnel-shaped balloon holder comprising a cup 22 and a hollow stem 24. Stem 24 is joined to the outside of cup 22 and extends longitudinally therefrom.

Cup 22 is preferably conical (or, strictly speaking, frustoconical), with either a circular (as shown) or oval cross section. A right circular cone with a vertical axis as shown is ordinarily preferred for ease of fabrication.

Cup 22 is adapted to receive a balloon 26 having a neck or tail 27, and stem 24 is adapted to be inserted into one end of a hollow cylindrical balloon stick 28, as will be described in greater detail with reference to FIG. 13.

Cup 22 comprises, from top to bottom, an outer edge or rim 30, a downwardly and inwardly sloping side wall 32, and a base 34. Rim 30 as shown is a circular (or annular) horizontal flange, but may be simply a lip. Rim 30 may be oval in shape 22 is of oval shape. Other suitable cup shapes include hemispherical and hemi-ellipsoidal Base 34 as shown is a horizontal annular surface with a circular central opening. Base 34 is coaxial with rim 30 and side wall 32. Base 34 is not necessarily separate and distinct from side wall 32; for example, a hemispherical cup surface may embrace both. Usually rim 30, side wall 32 and base 34 are coaxial, however.

Cup 22 has an opening for insertion of the neck of a balloon. This opening is preferably a vertical slit 38 that extends longitudinally the entire height of the cup, from rim 30 to base 34. Slit 38 is for insertion of a balloon neck 27 into holder 20. Slit 38 is symmetrical and comprises an enlargement 38*a* formed by a first pair of tapered vertical surfaces at its outer end, i.e. at rim 30, and a main portion 38*b*, formed by a pair of parallel vertical surfaces. The slit 38 is wide at its outer end (at rim 30) to make it easy to insert a balloon neck 27.

A cylindrical collar 40 may be formed on the underside of cup base 34, between cup 22 and stem 24. Collar 40 is of slightly larger diameter than stem 24, forming a shoulder 42 which serves as a limit stop for the upper end of balloon stick 28. Collar 40 has a chamfered passageway 44 extending therethrough. Passageway 44 is in communication with the inside of cup 22.

Figure 5:
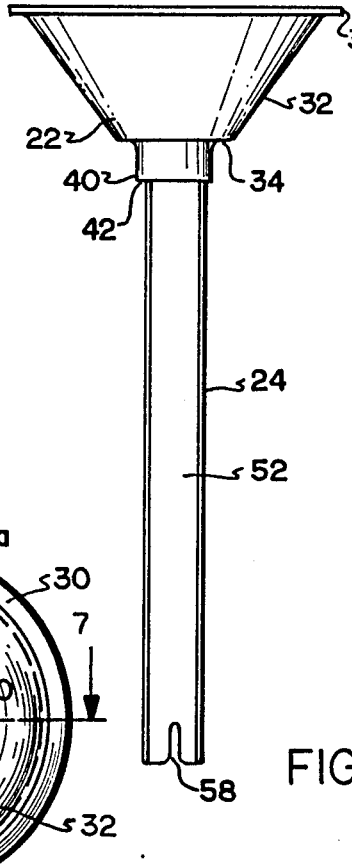
FIG. 5 is a back elevational view of the balloon holder shown in FIG. 4.

Stem 24 is joined to cup 22 at it axis through collar 40 and extends downwardly along the axis of cup 22. Stem 24 is of generally cylindrical cross section, as shown in FIGS. 3 and 5, and comprises two intersecting longitudinally extending exterior surfaces, i.e. a vertical cylindrical surface 50 of circular cross-section, and a flat surface 52. Cylindrical surface 50 is coaxial with cup 22, and has a diameter just slightly less than the inside diameter of balloon stick 28. In effect, stem 24 has a cutout exterior portion, formed by flat surface 52, leaving a space 54 for a portion of balloon neck 27 between stem 24 and balloon stick 28, as best seen in FIG. 5. Stem 24 has a longitudinal bore 56 which is open at both ends and which forms a cavity or space for a portion of the neck 27 of balloon 26. Bore 56 is cylindrical and of circular cross section but is off center, i.e., the axis of bore 56 does not coincide with the axis of cup 22 and exterior surface 50, so that the wall thickness between surfaces 52 and bore 56 will be sufficient for structural strength. Stem 24 has a vertical slit 57 which extends through the stem wall from curved surface 50 to bore 56 and which extends longitudinally the entire height of collar 40 and stem 24. Slit 57 preferably has the same width as slit 38. Slit 57 is aligned with slit 38 to form a single slit which extends the entire length of balloon holder 20, so as to permit insertion of a balloon neck 27 into bore 56. A balloon neck, once inserted, will stay in, because slit 57 is narrower than the widest portion of bore 56. A short notch or slot 58, at the bottom of stem 24 through the wall between flat surface 52 and bore 56, is provided for anchoring balloon neck 27. Notch 58 is rounded at the bottom. Notch 58 and flat surface 52 are diametrically opposite slits 57 and 38. The balloon neck extends downwardly through bore 56, is anchored in notch 58, and then extends upwardly in cavity 54. The entire balloon neck 27 is concealed inside balloon stick 28. Balloon holders 20 shown in FIGS. 4–8 are particularly suitable for use with metallized "Mylar" balloons of 4 inch or larger diameter.

Figure 6:
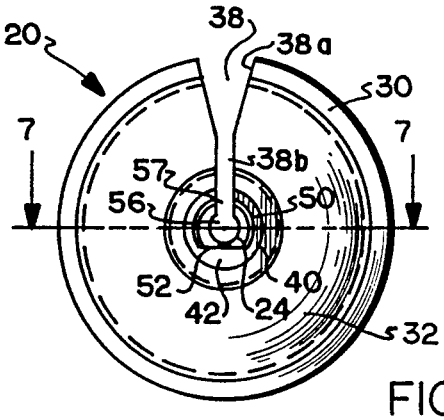
FIG. 6 is a bottom plan view looking up, of a balloon holder.
Figure 8:
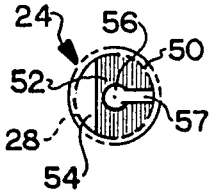
FIG. 8 is a horizontal sectional view, taken along line 8—8 of FIG. 7, showing the cross-sectional shape of the stem according to a second embodiment of the invention.
Figure 9:
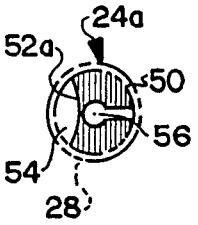
FIGS. 9, 10 and 11 are horizontal sectional views showing the cross-sectional shapes of stems according to further embodiments of this invention.
Figure 10:
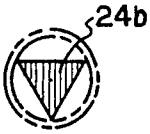
Figure 11:
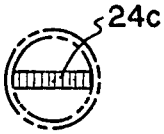

The shape of stem 24 can be different from that shown in FIGS. 6 and 8, such that the stem can be inserted into the end of a hollow balloon stick with space provided for a balloon neck between the stem and the balloon stick. Three alternative stem shapes are shown in FIGS. 9 to 11. Each of these figures is a horizontal section through the stem.

FIG. 9 shows a stem **24*a* having a cylindrical surface 50 and a reverse curved cutout surface 52*a*. This surface, like its counterpart 52, forms a space for a portion of a balloon neck. Surfaces 52 and 52*a* both intersect surface 50 and extend radially inwardly therefrom, thus forming a space for a portion of the balloon neck. Stem 24*a* has a bore 56, similar to that in FIGS. 6 and 8, for the remaining portion of the balloon neck. FIG. 10 shows a triangular stem 24*b*. One side of the triangle is preferably perpendicular to the center plane of slit 38. (The center plane is a vertical plane which passes midway between each Pair of opposed surfaces which form portions 38*a* and 38*b*). The spaces between the three faces of stem 24*b* and balloon stick 28** provide spaces in which the balloon neck may be disposed.

FIG. 11 shows a thin flat stem **24*c*, similar in shape to a popsicle stick, which is perpendicular to the center plane of slit 38. The downwardly extending portion of a balloon neck may be disposed on one side of stem 24*c***, and the upwardly extending portion of the neck on the other side of the stem.

Balloon stick 28 is shown in dotted lines in each of FIGS. 5 to 9. In each case the stem has a plurality of peripheral points which are at equal radii from the central axis of device 20. (The equal radii are just slightly less than the radius of balloon stick 28). Also, each stem has other points on its outer surface which are at less distance from the central axis than the peripheral points, so that there is space for a balloon neck as shown in FIGS. 9–11. Each of the stems **24*a*, 24*b*, 24*c* may be provided with a notch 58 at its lower end for anchoring a balloon neck. In the embodiments of FIGS. 9–11, slit 38 terminates at the lower end of cup 22. i.e. at base 34, and there is no counterpart of slit 57 in stem 24**.

Preferred dimensions for a balloon holder 20 to be used for securing a balloon having a 4 inch neck are as shown in Table I below. In Table I, linear dimensions are in inches and angular measurements are in degrees. (1 inch=2.54 cm).

TABLE I

| Parameter | Dimension |
|---|---|
| Overall length | 2.59" |
| Length of stem 24 | 2.00" |
| Length of collar 40 | 0.125" |
| Height of cup 22 | 0.465" |
| Maximum diameter (diameter of rim 30) | 1.06" |
| Wall thickness of cup 22 | 0.030" |
| Angle of cup side wall 32[a] | 35° |
| Width of slits 38 and 57 | 0.040" |
| Diameter of collar 40 | 0.235" |
| Outside diameter of stem 24 | 0.190" |
| Depth of notch 58 | 0.150" |
| Diameter of bore 56 | 0.100" |
| Taper angle of enlargement 38a[b] | 15° |

[a]Measured from vertical axis to side wall
[b]Measured from vertical axis to tapered surface While the above dimensions are representative of a first embodiment, the dimensions may be varied as long as the holder is of sufficient length to completely conceal the balloon neck.

The balloon holder of the invention may also be used for short neck latex balloons. The overall length in that case will be much shorter than the length indicated in Table I above.

Figure 12:
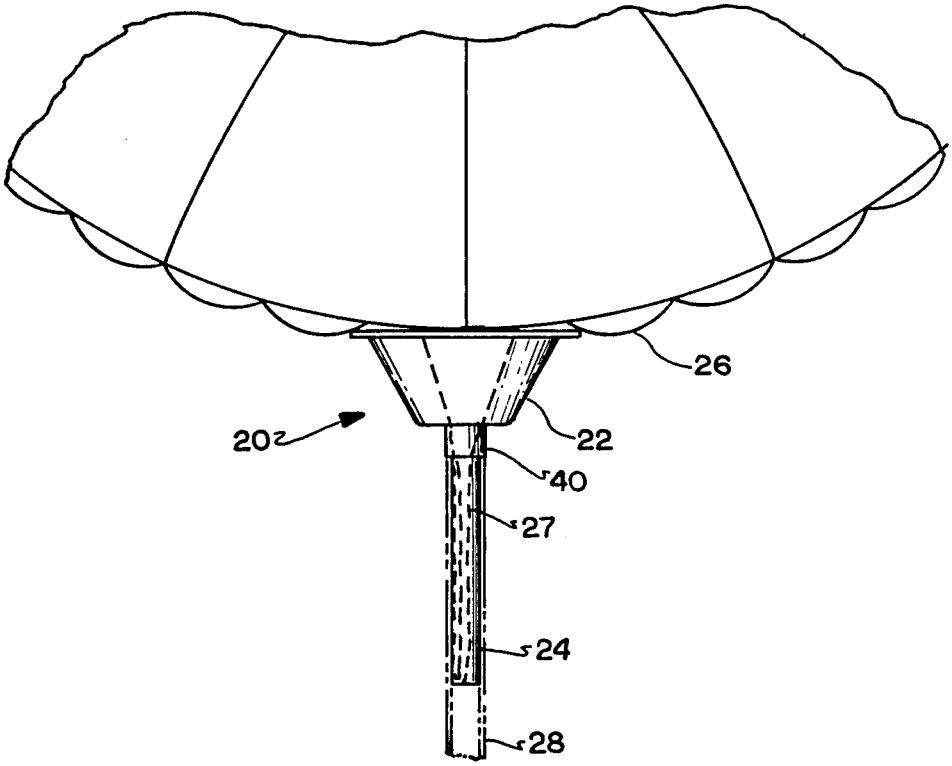
FIG. 12 is a side elevational view of a balloon holder of FIG. 4, with a balloon secured thereto and with all but the lower portion of the balloon broken away.

FIG. 12 shows a balloon holder 20 having a balloon 26 secured thereto, and with one end of a balloon stick 28 surrounding stem 24. All except the lower portion of balloon 26 has been broken away. The envelope **26*a* of balloon 26 rests squarely on rim 30, instead of being off center as in prior art balloon holders. The neck 27 of balloon 26 extends downwardly virtually along the center axis of balloon holder 20, through passageway 44 and bore 56, to notch 58. Neck 27 engages notch 58, and the remainder of the neck extends upwardly through space 54, terminating short of shoulder 44. The length of stem 24 is at least one-half the length of balloon neck 27, so that the entire length of neck 27 will be contained in either passageway 44, bore 56 or space 54. The entire length of neck 27** is concealed, there is no visible tail as there is in the case of previously known balloon holders.

Balloon neck 27 can be inserted into balloon holder 20 simply by pulling the neck radially inwardly through slit 38, i.e. from the outside to the inside of cup 22, until the greater part of the neck extends downwardly through bore 56. Neck 27 is inserted into notch 58, and the remainder of neck 27 is pulled upwardly alongside flat surface 52 with a slight tug. Notch 58 pinches the neck 27 and anchors the balloon 26 in place. Finally, stem 24 and neck 27 are inserted into one end of a balloon stick 28.

The balloon holder of this invention offers several advantages over prior art balloon holders. First, the balloon is centered in the holder so that it does not flop around and is less prone to escape. Also, (particularly in the embodiment of FIGS. 4–8), the appearance is more pleasing Second, a balloon can be inserted rapidly into the holder of this invention and not much manual dexterity is required. The slit permits quick insertion, and no time for winding the balloon neck around the cup will be required since the need to wind the neck to hide it and affix it more securely, will be completely eliminated. Third, the balloon neck is completely concealed in the embodiments of FIGS. 4–12, which is also pleasing in appearance. Fourth, the balloon is unlikely to escape; this is due partly to correct centering and partly to the presence of a notch for anchoring the balloon neck at the bottom of the stem. Other advantages will be apparent to those skilled in the art.

While in accordance with the patent statutes, a preferred embodiment and best mode has been presented, the scope of the invention is not limited thereto, but rather is measured by the scope of the attached claims.

What is claimed is:

1. A funnel-shaped, one piece balloon holder, open at both ends and comprising:

(a) an open cup comprising a base, an outer edge, and a sloping sidewall which slopes inwardly from said outer edge to said base, (b) a hollow cylindrical stem extending longitudinally from the base of said cup on the outside thereof, (c) a longitudinal slit for insertion of the neck of a balloon into said balloon holder, said slit extending the entire length of said balloon holder form the outer edge of the cup to the outer end of said stem; and (d) a short slot at one end of said balloon holder for engaging said neck and thereby securing said balloon to said cup.

2. A balloon assembly comprising a balloon having a neck, a one-piece funnel-shaped balloon holder comprising an open cup and a hollow cylindrical stem extending longitudinally from the outside of said cup and a balloon stick held by said stem, said cup having a sloping sidewall which slopes inwardly form the outer edge of said cup to the junction between the cup and the stem, said balloon holder having a longitudinal slit extending the entire length thereof from the outer edge of said cup to the outer end of said stem for insertion of said neck of said balloon, and a short slot at one end of said balloon holder for engaging said neck and thereby securing said balloon to said cup.

3. A balloon holder according to claim 1 in which said stem is a hollow right circular cylinder adapted to receive a balloon stick having an outside diameter slightly less than the inside diameter of the stem.

4. A balloon holder according to claim 1 in which said cup is frustoconical.

5. A balloon holder according to claim 1 in which said longitudinal slit is enlarged at the outer edge of said cup.

6. A balloon holder according to claim 1 in which said slot is diametrically opposite said longitudinal slit.

7. A balloon holder according to claim 1 in which said slot is at the outer end of said stem.

* * * * *